United States Patent [19]

Garrone

[11] 4,041,959

[45] Aug. 16, 1977

[54] BRAID FORMING METHOD AND APPARATUS

[75] Inventor: Franco Garrone, Bologna, Italy

[73] Assignee: AMF Incorporated, White Plains, N.Y.

[21] Appl. No.: 721,264

[22] Filed: Sept. 8, 1976

[30] Foreign Application Priority Data

Oct. 8, 1975 Italy ..... 12825/75

[51] Int. Cl.[2] ..... A24C 5/18

[52] U.S. Cl. ..... 131/84 B; 131/110; 302/38

[58] Field of Search ..... 131/84 R, 84 B, 66, 131/20 R, 108, 109 B, 110; 308/37, 38

[56] References Cited

U.S. PATENT DOCUMENTS

| | | | |
|---|---|---|---|
| 3,034,514 | 5/1968 | Pinkham | 131/84 B |
| 3,088,467 | 5/1963 | Lanore | 131/20 R |
| 3,563,249 | 2/1971 | Geyer et al. | 131/84 B |
| 3,724,908 | 4/1973 | Buerough et al. | 302/38 X |
| 3,736,941 | 6/1973 | Molins et al. | 131/21 R |

*Primary Examiner*—Stephen C. Pellegrino

*Attorney, Agent, or Firm*—George W. Price; Charles J. Worth

[57] ABSTRACT

Apparatus for forming a cut tobacco braid in a cigarette maker including a duct of T-shaped cross-sectional configuration having a rectangular inlet and outlet disposed orthogonal to each other; the arms of the T-shape being symmetrically tapered from the inlet to the outlet and the leg of the T-shape being tapered from the outlet to the inlet.

9 Claims, 7 Drawing Figures

103

103
103
203

103
103
203

103
103
203

IV
IV
V
V

VI
VI
3
103
VII
VII
203
303
6

BRAID FORMING METHOD AND APPARATUS

This invention relates generally to cigarette makers in which a continuous and uniform braid of cut tobacco is formed and wrapped in a paper tape thus making a continuous rod which is sequentially cut into individual cigarettes of equal length, and more particularly to the forming and delivery of the braid to the tape.

It is well known that the long and narrow braid will move in a path parallel to and in the same direction as the paper tape in which it will be wrapped, and preferably parallel to and in the same direction as the thin layer of cut tobacco being provided at the discharge of the carding unit located below the feed hopper. Under such conditions, the discharge of the carding unit is parallel to the axis of the carding drum and the width of the thin layer of cut tobacco, which is substantial, issuing from the carding unit discharge is orthogonal to the path of the advancing braid to be wrapped. Thus, a change in direction or reforming of a short and wide layer of cut tobacco into a long and narrow braid is required, and must be accomplished by disturbing as little as possible the uniformity of the cut tobacco distribution obtained with a carding unit if a soft, dense and uniform braid is to be formed.

Accordingly, an object of the present invention is to provide a braid forming path receiving short and wide strips of cut tabacco and delivering such tobacco in long and narrow portions of braid to a suction tape at the braid advancing path parallel to the path of the paper tape.

Another object of the present invention is to provide a T-shaped duct for the foregoing braid forming path which has a progressively changing cross-sectional shape from its inlet to its outlet and has a constant cross-sectional area.

And another object of the present invention is to provide the foregoing T-shaped duct in which the T wings symmetrically converge towards the root of the rib in this transfer direction, that is, from the carding unit towards the tape, while the T rib starts from the T main plane, slightly above the carding unit outlet and progressively grows in height, in concomitance with the reduction in width of the wings, until it reaches a maximum height which is approximately at the suction tape catching side where the above wings are reduced to a minimum which can even reach the complete annulment of their width. In other words the arms forming the main plane or cross portion of the T symmetrically taper from the inlet to the outlet of the duct while the rib or leg of the T tapers from the outlet to the inlet of the duct. Therefore, the arms or wings of the T progressively reduce equally from the inlet to the outlet of the duct in concomitance with progressive increase in height of the rib or leg of the T.

Preferably, the convergency of the wings and the variation in height of the rib of said T duct are correlated to each other in such a way that the area of the duct cross section remains the same for all the extension of the duct itself. Located in the area of the T-shaped duct outlet on the side facing the suction tape, is a small hood in which a required degree of suction is maintained to establish through this T-shaped duct the current which engages and drags the cut tobacco from the carding unit to the suction tape.

The foregoing and other objects and advantages of the invention will appear more fully hereinafter from a consideration of the detailed description which follows, taken together with the accompanying drawing wherein a single embodiment of the invention is illustrated by way of example. It is to be expressly understood, however, that the drawing is for illustration purposes only and is not to be construed as defining the limits of the invention.

Figure 1:
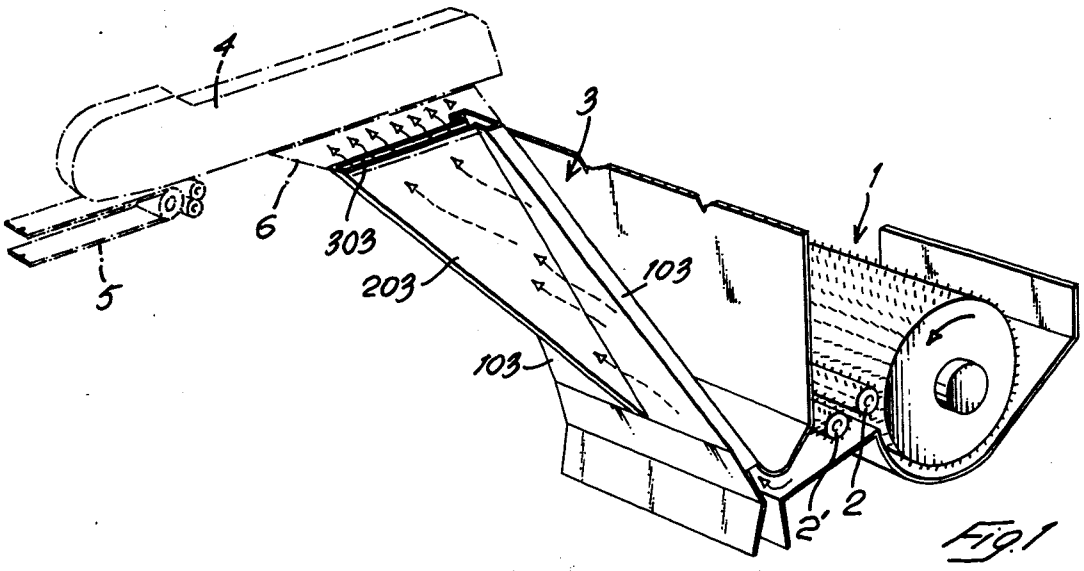
FIG. 1 is a perspective view of apparatus made in accordance with the present invention.
Figure 2:
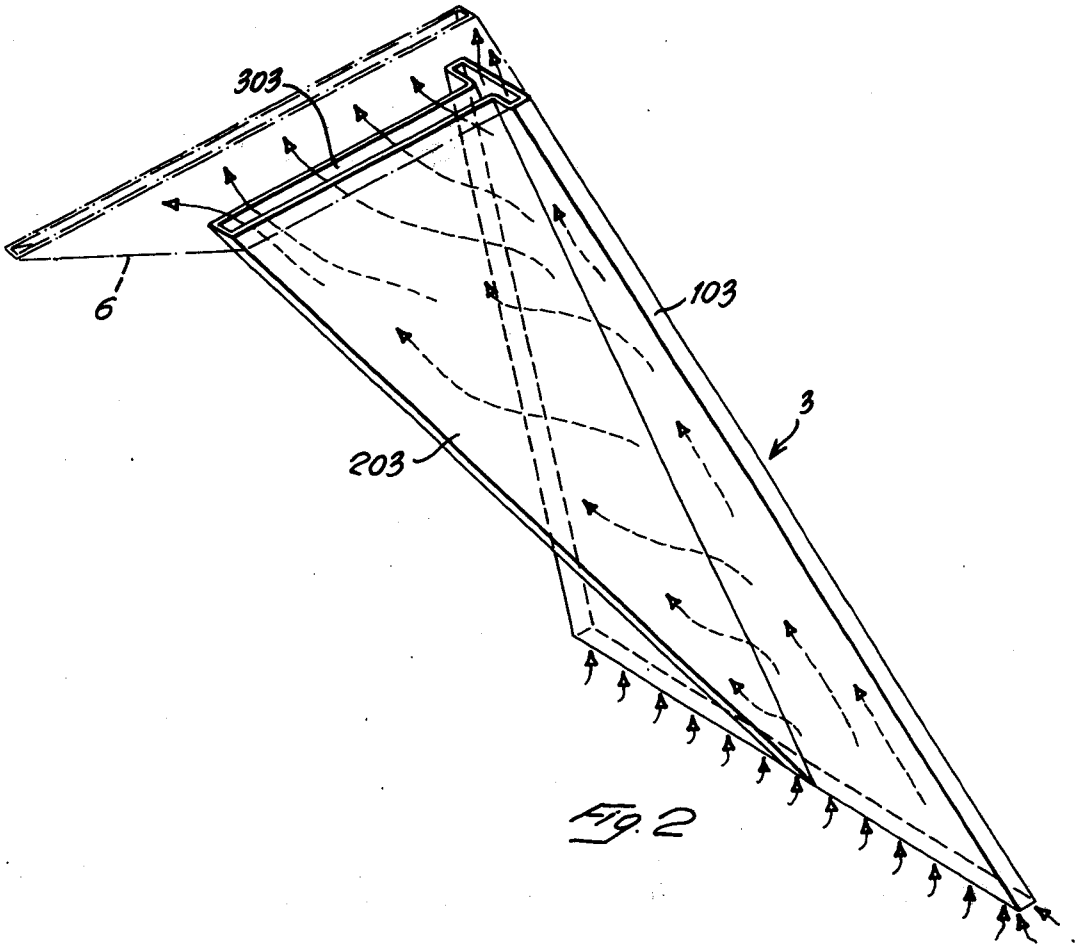
FIGS. 2 and 3 are enlarged perspective and side elevational views, respectively of the T-shaped duct of FIG. 1.

With reference to the drawings and, particularly to FIG. 1, for general information, in the continuous cut tobacco braid formation, cut tabacco supplied from a feed hopper distributes on a carding unit 1 where the cut tabacco is spread in the shape of a finely distributed thin layer. The cut tabacco is removed from the carding drum by a picker roller 2 and is sent by winnower 2', so spread, in a strip fashion through the discharge of the carding unit 1 to the inlet of a transfer duct 3. The outlet of discharge of duct 3 is operatively associated with or is adjacent to the suction tape, mounted in a box 4, which condenses the cut tobacco into a braid shape and delivers it to tape 5 of the forming path where the braid will be associated with or wrapped in a paper tape, to finally form a continuous cigarette rod. As shown in an "in-line" forming machine, the pneumatic transferring unit or duct 3 draws the cut tobacco at its inlet along a line which is parallel to the axis of rotation of carding drum 1 and, subsequently, delivers it to the tape in box 4 along a line which is substantially orthogonal to the drawing line.

In the apparatus according to the invention, the function of orthogonal cut tobacco transfer from the carding unit outlet to the rod forming area is obtained by means of a characteristic transfer duct consisting of an asymmetric tubular element, with generically T-shaped sections, having a longitudinal configuration in which each right section of the duct has a T-shaped configuration, with wings or arms 103 and a rib or leg 203. The wings or arms 103 symmetrically taper or converge towards the middle longitudinal line of the T main plane in the area of which there perpendicularly rises the rib or leg 203, such convergency being developed, in relation to the rib root, in the cut tobacco transfer direction from carding unit 1 to pneumatic tape in the box 4. The rib or leg 203 starts from the table or main plane formed by arms 103, a little above the outlet or discharge of the carding unit 1 and progressively increases in height, in concomitance with the reduction in width of wings or arms 103 of the duct 3 until the rib or leg 203 reaches a maximum height at the outlet 303 facing the catching side of the suction section of the braid forming tape in the box 4.

At outlet 303 at the top of duct 3, the wings or arms 103 are reduced to a minimum width even to the point of disappearing at this outlet or a little before it. An appropriately shaped hood 6 is provided between the outlet 303 of the duct 3 and the box or casing 4, as is shown. The small hood 6 is provided with appropriate suction units (not shown) which maintain a required degree or suction to draw into duct 3 the current which engages and conveys the cut tobacco, guiding in an orderly manner its trajectories, from the carding unit to the tape within the box or casing 4. As shown in the drawings, the main plane, formed by the wings or arms 103, at the lower or inlet end of the duct 3 has the shape of a regular prismatic flat tube, with a trapezoidal longitudinal section while the duct portion corresponding to the T rib or leg 203 has the shape of a regular prismatic flat tube with a triangular longitudinal section. Both duct portions have smooth walls and their heights or thicknesses are preferably so commensurated between each other that the cross-sectional area of duct 3 is constant along its full length or path from the duct inlet to the duct outlet 303.

Figures 3, 4, 5, 6, 7:
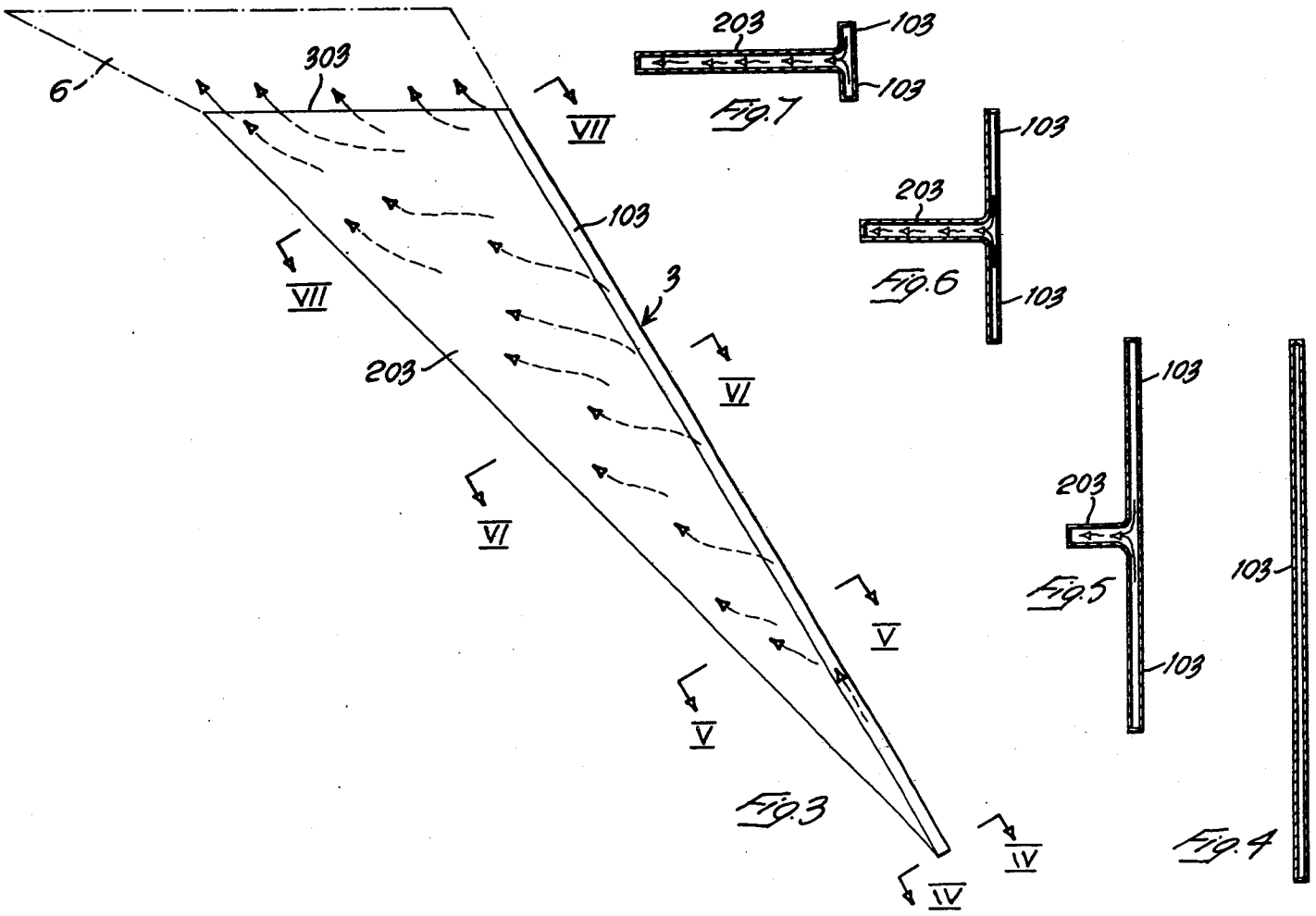
FIGS. 4, 5, 6 and 7 are sectional views taken on lines IV—IV, V—V, VI—VI and VII—VII, respectively, of FIG. 3.

In accordance with the invention, the duct 3 which guides the cut tobacco from the direction of cut tobacco collection from the carding drum to the braid forming direction, has substantially an airplane tail configuration, with the cut tobacco collecting plane corresponding to the horizontal tail planes while the delivery plane corresponds substantially to the vertical tail plane. This configuration facilitates the uniform development of the fluid threads, destined to transfer the cut tobacco regularly between planes substantially perpendicular to each other. This configuration avoids the forming of whirls or eddies in the threads and the consequent lack of uniformity in the cut tobacco transferring local density. It should be noted that the flow of tobacco in the wings or arms 103 is vertically, and laterally in opposition to each other toward the root of the rib or leg 203 where flows in both of the wings or arms 103 merge. At this point the merge flow in the rib or leg 203 is vertically, and longitudinally in the direction of travel of the suction tape in the box or casing 4. Because of the cant or slope of the overall duct 3 as clearly illustrated by FIG. 3, the overall flow from the inlet to the outlet 303 will have a longitudinal flow component.

Although only a single embodiment of the invention has been illustrated and described in detail, it is to be expressly understood that the invention is not limited thereto. Various changes may be made in the design and arrangement of the parts without departing from the spirit and scope of the invention as the same will now be understood by those skilled in the art.

What is claimed is:

1. Apparatus for forming a continuous cut tobacco braid in a cigarette maker, comprising a substantially vertical T-shaped duct means with smooth walls having a longitudinally disposed leg and a pair of arms extending laterally from the root of said leg, said duct means having an inlet at one end for receiving cut tobacco from a carding unit and an oulet at the other end for discharging cut tobacco to an endless belt type braid forming tape, said inlet and outlet having generally the same geometrical shape and being disposed orthogonal to each other, said arms being symmetrical to one another and tapered from said inlet to said outlet, said leg being tapered from said outlet to said inlet, and means at one end of said duct means for creating an air flow conveying cut tobacco from said inlet to said outlet.

2. The apparatus in accordance with claim 1, and the taper of said arms being correlated to the taper of said leg such that the cross-sectional area of said duct means is constant from said inlet to said outlet.

3. The apparatus in accordance with claim 2, and said inlet and outlet each having a rectangular configuration.

4. The apparatus in accordance with claim 3, and the taper causing the flow through each of said arms to progressively merge with the flow through the other of said arms and thereafter flow through said leg.

5. The apparatus in accordance with claim 4, and a hood disposed at said outlet and adapted for connection to suction creating air flow through said duct means.

6. The apparatus in accordance with claim 5, and said duct means being sloped longitudinally in the direction of extension of said leg from said arms.

7. Apparatus for forming a continuous cut tobacco braid in line with the cut tobacco feed hopper in a cigarette maker, where the cut tobacco is continuously taken from the outlet line of the carding unit fed by the hopper and is delivered to the braid forming line by means of pheumatic transfer through a shaped duct, said device being characterized by the fact that this transfer from the outlet line to the forming line which are substantially orthogonal to each other, is obtained by having the duct assume a flat T-shaped configuration with smooth walls, in which the wing of the T symmetrically converge towards the root of the rib of the T in the direction of this cut tobacco transfer, while the rib of the T starts from the T table or main plane, a little above the carding unit outlet, and, then, progressively grows in height, in concomitance with the decrease in width of the wings until a maximum height is reached approximately in the area of the catching side of the in-line pneumatic braid forming tape where, on the contrary, the duct wings are reduced to a minimum width, which may even reach the complete annulment of the width of said wings.

8. Apparatus in accordance with claim 7 in which the central symmetric convergency of the wings of the T-shaped duct and the variation in height of the duct rib, are correlated to each other in such a way that the area of the duct cross suction remains constant for the full extent of the duct.

9. Apparatus in accordance with claim 8, in which, at the outlet of the T-shaped duct on the side facing the pneumatic tobacco braid forming tape, there is provided an inducing hood in which a degree of suction is maintained to establish through this duct the current for engaging the cut tobacco from the carding unit and for conveying it in an orderly manner to the braid forming tape.

* * * * *